US007973525B2

(12) United States Patent
Mitani et al.

(10) Patent No.: US 7,973,525 B2
(45) Date of Patent: Jul. 5, 2011

(54) CONSTANT CURRENT CIRCUIT

(75) Inventors: Makoto Mitani, Chiba (JP); Fumiyasu Utsunomiya, Chiba (JP)

(73) Assignee: Seiko Instruments Inc., Chiba (JP)

( * ) Notice: Subject to any disclaimer, the term of this patent is extended or adjusted under 35 U.S.C. 154(b) by 215 days.

(21) Appl. No.: 12/367,740

(22) Filed: Feb. 9, 2009

(65) Prior Publication Data

US 2009/0201006 A1 Aug. 13, 2009

(30) Foreign Application Priority Data

Feb. 13, 2008 (JP) ..... 2008-031613

(51) Int. Cl.
*G05F 3/04* (2006.01)

(52) U.S. Cl. ..... 323/312

(58) Field of Classification Search ..... 323/311, 323/312, 315, 316, 317
See application file for complete search history.

(56) References Cited

U.S. PATENT DOCUMENTS 5,180,967 A * 1/1993 Yamazaki ..... 323/315

FOREIGN PATENT DOCUMENTS

JP 3-238513 A 10/1991
JP 6-152272 A 5/1994

* cited by examiner

*Primary Examiner* — Adolf Berhane
(74) *Attorney, Agent, or Firm* — Brinks Hofer Gilson & Lione

(57) ABSTRACT

Provided is a constant current circuit capable of supplying a stable constant current. Even when K values of NMOS transistors vary due to manufacturing fluctuations in semiconductor devices, a voltage generated across a resistor is always a threshold voltage difference between the NMOS transistors, and thus hardly varies. Even when the K values of the NMOS transistors vary due to a change in temperature, the voltage generated across the resistor is always the threshold voltage difference between the NMOS transistors, and thus hardly varies.

4 Claims, 2 Drawing Sheets

CONSTANT CURRENT CIRCUIT

RELATED APPLICATIONS

This application claims priority under 35 U.S.C. §119 to Japanese Patent Application No. JP2008-031613 filed on Feb. 13, 2008, the entire content of which is hereby incorporated by reference.

BACKGROUND OF THE INVENTION

1. Field of the Invention

The present invention relates to a constant current circuit for supplying a constant current.

2. Description of the Related Art

At present, there is a case where a constant current circuit for supplying a constant current is mounted on a semiconductor device.

A conventional constant current circuit is described. FIG. 3 illustrates the conventional constant current circuit.

A K value (driving capacity) of a PMOS transistor P1 is higher than a K value of a PMOS transistor P2, or a K value of an NMOS transistor N2 is higher than a K value of an NMOS transistor N1. A gate-source voltage difference between the NMOS transistors N1 and N2 is generated across a resistor R1, and hence a current flowing into the resistor R1 is a constant current (see, for example, JP 2803291 B (FIG. 1)).

A conventional constant current circuit for low current consumption is described. FIG. 4 illustrates the conventional constant current circuit for low current consumption.

The K value of the PMOS transistor P1 is higher than the K value of the PMOS transistor P2, or the K value of the NMOS transistor N2 is higher than the K value of the NMOS transistor N1. When a resistor R2 is provided between a gate and source of the NMOS transistor N1, a gate voltage of the NMOS transistor N2 becomes lower and thus the NMOS transistor N2 operates in a sub-threshold region, whereby the current consumption of the constant current circuit reduces. A voltage obtained by subtracting a voltage generated across the resistor R2 from the gate-source voltage difference between the NMOS transistors N1 and N2 is generated across the resistor R1, and hence a current flowing into the resistor R1 is a constant current (see, for example, JP 06-152272 A (FIG. 1)).

However, the K values of the NMOS transistors N1 and N2 vary due to a fluctuation in gate oxide film thickness during a semiconductor device manufacturing process. Therefore, the gate-source voltage difference between the NMOS transistors N1 and N2 varies. Then, the voltage generated across the resistor R1 varies, and hence the constant current of the constant current circuit varies. In other words, the constant current of the constant current circuit varies due to manufacturing fluctuations in semiconductor devices.

The carrier mobility of a MOS transistor has a temperature coefficient. Therefore, when a temperature increases, the K value becomes lower. When a temperature reduces, the K value becomes higher. That is, when a temperature changes, the K value also changes. Thus, the gate-source voltage difference between the NMOS transistors N1 and N2 also changes. Then, the voltage generated across the resistor R1 changes, and hence the constant current of the constant current circuit also changes. In other words, the constant current of the constant current circuit changes with a change in temperature.

Therefore, a constant current circuit capable of supplying a stable constant current irrespective of the manufacturing fluctuations in semiconductor devices and the change in temperature is required.

SUMMARY OF THE INVENTION

The present invention has been made in view of the problems described above. It is an object of the present invention to provide a constant current circuit capable of supplying a stable constant current.

In order to solve the above-mentioned problems, the present invention provides a constant current circuit for supplying a constant current, including: a second PMOS transistor; a first PMOS transistor through which a drain current flows based on a drain current of the second PMOS transistor; a first NMOS transistor through which a drain current equal to the drain current of the first PMOS transistor flows when a voltage based on a drain voltage of the first PMOS transistor is applied to a gate of the first NMOS transistor; a second NMOS transistor through which a drain current equal to the drain current of the second PMOS transistor flows when a voltage based on a gate voltage of the first NMOS transistor is applied to a gate of the second NMOS transistor, the second NMOS transistor being lower in threshold voltage than the first NMOS transistor; and a first resistor provided between a source of the second NMOS transistor and a ground terminal, for generating a voltage based on a threshold voltage difference between the first NMOS transistor and the second NMOS transistor to supply the constant current.

According to the present invention, even when K values of the first and second NMOS transistors vary due to manufacturing fluctuations in semiconductor devices, a voltage generated across the first resistor is always a threshold voltage difference between the first and second NMOS transistors and thus hardly varies, with the result that the constant current of the constant current circuit hardly varies.

Even when the K values of the first and second NMOS transistors vary due to a change in temperature, the voltage generated across the first resistor is always the threshold voltage difference between the first and second NMOS transistors and thus hardly varies, with the result that the constant current of the constant current circuit hardly varies.

Therefore, the constant current circuit may supply a stable constant current irrespective of the manufacturing fluctuations in semiconductor devices and the change in temperature.

DETAILED DESCRIPTION OF THE PREFERRED EMBODIMENTS

Hereinafter, embodiments of the present invention are described with reference to the attached drawings.

First Embodiment

Figure 1:
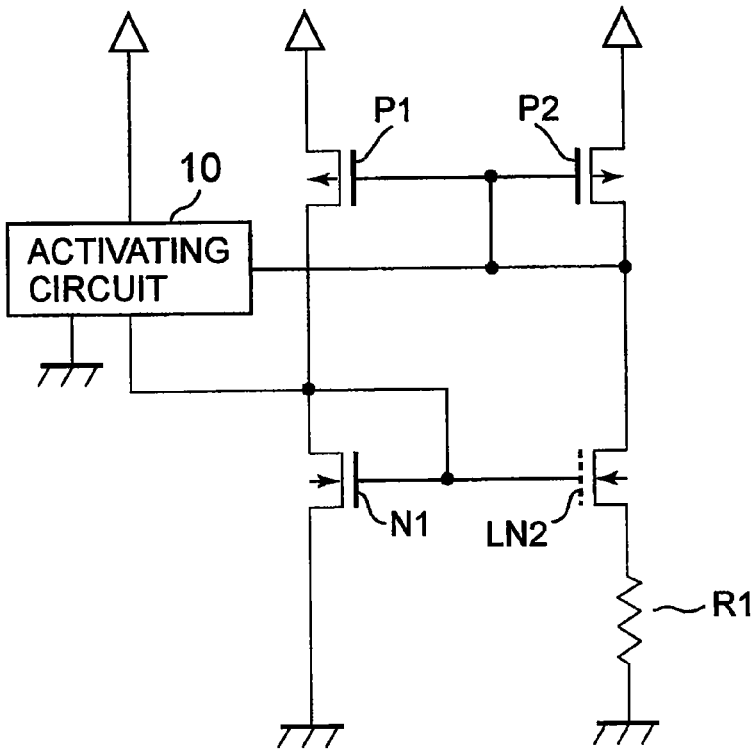
FIG. 1 illustrates a constant current circuit according to a first embodiment of the present invention.

A structure of a constant current circuit according to a first embodiment of the present invention is described. FIG. 1 illustrates the constant current circuit according to the first embodiment.

The constant current circuit includes an activating circuit 10, PMOS transistors P1 and P2, NMOS transistors N1 and LN2, and a resistor R1.

The activating circuit 10 is provided between a power supply terminal and a ground terminal and has an input terminal and an output terminal. The input terminal is connected to a gate of the PMOS transistor P1, a gate and drain of the PMOS transistor P2, and a drain of the NMOS transistor LN2. The output terminal is connected to a drain of the PMOS transistor P1, a gate and drain of the NMOS transistor N1, and a gate of the NMOS transistor LN2. Sources of the PMOS transistors P1 and P2 are connected to power supply terminals. A source of the NMOS transistor N1 is connected to the ground terminal. A source of the NMOS transistor LN2 is connected to one end of a resistor R1. The other end of the resistor R1 is connected to the ground terminal. The PMOS transistor P2 is diode-connected, and the PMOS transistors P1 and P2 are current-mirror connected to each other. The NMOS transistor N1 is diode-connected, and the NMOS transistors N1 and LN2 are current-mirror connected to each other.

The constant current circuit has two stable points, that is, a case where no current flows and a case where a constant current flows. The activating circuit 10 operates so as to shift the constant current circuit from the former case to the latter case. Specifically, when the constant current flowing through the resistor R1 is smaller than a predetermined current, the drain current of the PMOS transistor P2 and the drain current of the NMOS transistor LN2 are smaller than a predetermined current, and the gate voltage of the PMOS transistor P2 is equal to or larger than a predetermined voltage, the activating circuit 10 causes an activation current to flow from the power supply terminal to the gate of the NMOS transistor LN2, thereby activating the constant current circuit.

A drain current flows through the PMOS transistor P1 based on the drain current of the PMOS transistor P2. A voltage based on a drain voltage of the PMOS transistor P1 is applied to the gate of the NMOS transistor N1, and a drain current equal to the drain current of the PMOS transistor P1 flows through the NMOS transistor N1. A voltage based on a gate voltage of the NMOS transistor N1 is applied to the gate of the NMOS transistor LN2, and a drain current equal to the drain current of the PMOS transistor P2 flows through the NMOS transistor LN2. A K value (driving capacity) ratio between the PMOS transistors P1 and P2 is equal to a K value ratio between the NMOS transistors N1 and LN2. When the K value ratio between the PMOS transistors P1 and P2 is 1:1, the constant current circuit is designed such that the K value ratio between the NMOS transistors N1 and LN2 is also 1:1. When the K value ratio between the PMOS transistors P1 and P2 is 2:1, the constant current circuit is designed such that the K value ratio between the NMOS transistors N1 and LN2 is 2:1. In other words, a current density to the K value, of the current flowing through the PMOS transistor P1 and the NMOS transistor N1 is equal to a current density to the K value, of the current flowing through the PMOS transistor P2 and the NMOS transistor LN2. The NMOS transistor LN2 has a lower threshold voltage than the NMOS transistor N1.

The resistor R1 is a polysilicon resistor. The resistor R1 is used to generate a voltage obtained as the threshold voltage difference between the NMOS transistors N1 and LN2. The resistor R1 has a sheet resistance value of approximately 300Ω to 400Ω, and hence the resistance value of the resistor R1 hardly changes even when there are manufacturing fluctuations in semiconductor devices or a change in temperature.

Next, an operation of the constant current circuit is described.

Assume that the K value ratio between the PMOS transistors P1 and P2 is 1:1 and the K value ratio between the NMOS transistors N1 and LN2 is 1:1. Assume that the NMOS transistor N1 has a threshold voltage of 0.5 V, an overdrive voltage of 0.1 V, and a gate-source voltage of 0.6 V. Assume that the NMOS transistor LN2 has a threshold voltage of 0.2 V. Assume that the PMOS transistors P1 and P2 and the NMOS transistors N1 and LN2 operate in a saturation region.

In such a case, the K values and the drain currents of the PMOS transistors P1 and P2 are equal to each other and the K values and the drain currents of the NMOS transistors N1 and LN2 are equal to each other. Therefore, the current densities of the PMOS transistors P1 and P2 are equal to each other and the current densities of the NMOS transistors N1 and LN2 are equal to each other. Accordingly, an overdrive voltage of the NMOS transistor LN2 is equal to the overdrive voltage of the NMOS transistor N1, that is, 0.1 V, and a gate-source voltage of the NMOS transistor LN2 becomes a sum voltage (0.3 V) of the threshold voltage (0.2 V) and the overdrive voltage (0.1 V). Thus, a voltage generated across the resistor R is 0.3 V because the gate-source voltage of the NMOS transistor N1 is 0.6 V and the gate-source voltage of the NMOS transistor LN2 is 0.3 V. In other words, the generated voltage is a gate-source voltage difference between the NMOS transistors N1 and LN2. The overdrive voltages of the NMOS transistors N1 and LN2 are equal to each other, that is, 0.1 V, and hence the voltage generated across the resistor R is a threshold voltage difference between the NMOS transistors N1 and LN2 (0.5 V−0.2 V=0.3 V). A constant current is supplied through the resistor R based on the generated voltage. The constant current is fed from the constant current circuit to the outside through a current mirror circuit (not shown).

Assume that the threshold voltage of the NMOS transistor N1 is expressed by Vt1, the overdrive voltage thereof is expressed by Vo1, the gate-source voltage thereof is expressed by Vgs1, the threshold voltage of the NMOS transistor LN2 is expressed by Vt2, the overdrive voltage thereof is expressed by Vo2, and the gate-source voltage thereof is expressed by Vgs2. In this case, a voltage Vref generated across the resistor R1 is calculated as follows.

$$Vref=Vgs1-Vgs2=(Vo1+Vt1)-(Vo2+Vt2) \quad (1)$$

The overdrive voltages of the NMOS transistors N1 and LN2 are equal to each other, and hence the voltage Vref is calculated as follows.

$$Vref=Vt1-Vt2 \quad (2)$$

In a normal semiconductor device manufacturing process, a fluctuation in threshold voltage difference between the NMOS transistors N1 and LN2, which is caused by manufacturing fluctuations is small. Changes in threshold voltages of the NMOS transistors N1 and LN2, which are caused by a change in temperature are substantially equal to each other. Therefore, even when a temperature changes, the threshold voltage difference between the NMOS transistors N1 and LN2 hardly changes.

Assume that, due to manufacturing fluctuations in semiconductor devices, the K values of the NMOS transistors N1 and LN2 vary. Assume that, due to a change in temperature, the K values of the NMOS transistors N1 and LN2 vary.

In this case, when the K values vary (change), the overdrive voltages of the NMOS transistors N1 and LN2 similarly vary (change), and hence an overdrive voltage difference between the NMOS transistors N1 and LN2 hardly varies from 0 V (hardly changes from 0 V). Thus, the voltage generated across the resistor R1 is always the threshold voltage difference between the NMOS transistors N1 and LN2 and is maintained to be 0.3 V. A constant current is supplied through the resistor R based on the generated voltage. The constant current is fed from the constant current circuit to the outside through a current mirror circuit (not shown).

With this structure, even when the K values of the NMOS transistors N1 and LN2 vary due to the manufacturing fluctuations in semiconductor devices, the gate-source voltage difference between the NMOS transistors N1 and LN2 and the overdrive voltage difference therebetween hardly vary. Then, the voltage generated across the resistor R is always the threshold voltage difference between the NMOS transistors N1 and LN2 and thus hardly varies, with the result that the constant current of the constant current circuit hardly varies.

Even when the K values of the NMOS transistors N1 and LN2 vary due to the change in temperature, the gate-source voltage difference between the NMOS transistors N1 and LN2 and the overdrive voltage difference therebetween hardly vary. Then, the voltage generated across the resistor R is always the threshold voltage difference between the NMOS transistors N1 and LN2 and thus hardly varies, with the result that the constant current of the constant current circuit hardly varies.

Thus, the constant current circuit may supply a stable constant current irrespective of the manufacturing fluctuations in semiconductor devices and the change in temperature.

Second Embodiment

Figure 2:
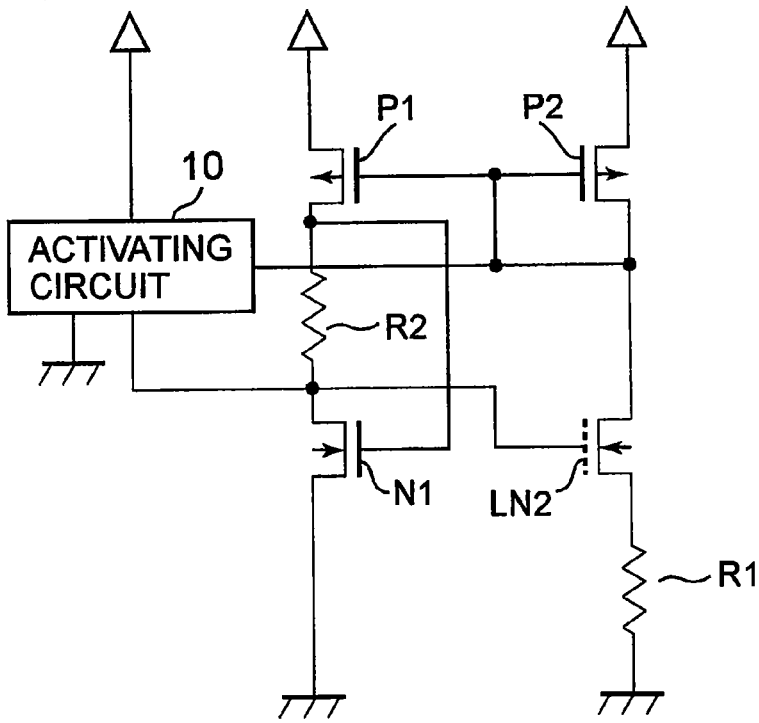
FIG. 2 illustrates a constant current circuit according to a second embodiment of the present invention.
Figure 3:
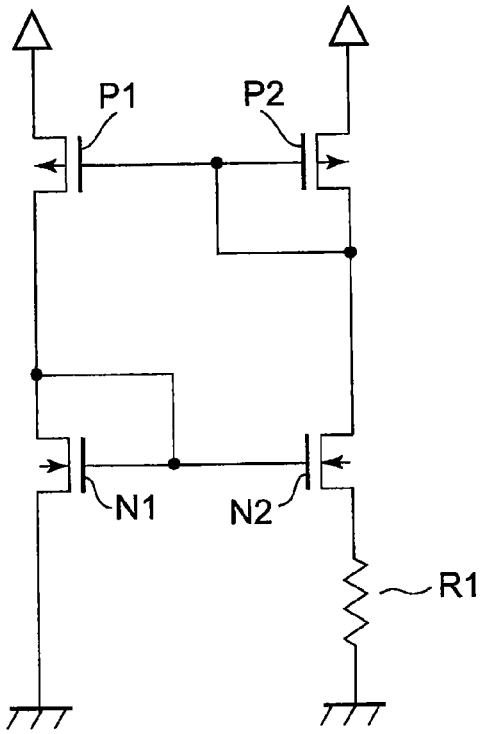
FIG. 3 PRIOR ART
FIG. 3 illustrates a conventional constant current circuit.
Figure 4:
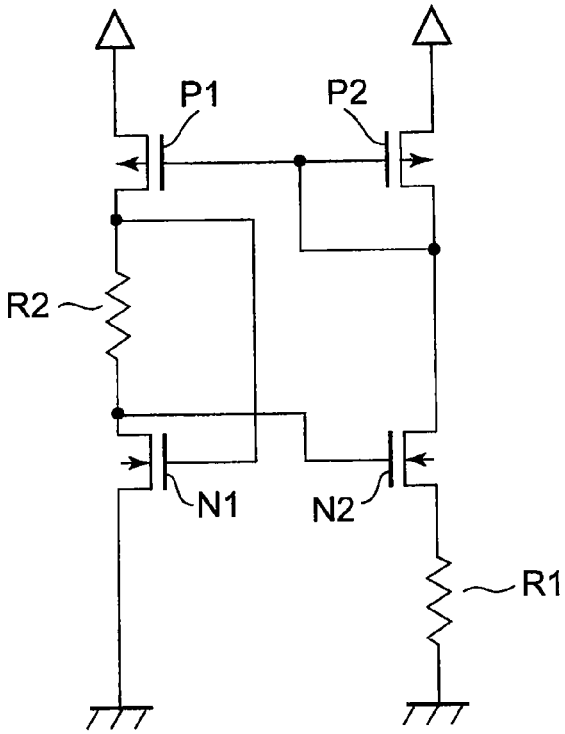
FIG. 4 PRIOR ART
FIG. 4 illustrates another conventional constant current circuit.

Next, a structure of a constant current circuit according to a second embodiment of the present invention is described. FIG. 2 illustrates the constant current circuit according to the second embodiment.

The constant current circuit according to the second embodiment further includes a resistor R2, unlike the first embodiment.

The resistor R2 is provided between the gate and drain of the NMOS transistor N1.

The constant current circuit has two stable points, that is, a case where no current flows and a case where a constant current flows. The activating circuit 10 operates so as to shift the constant current circuit from the former case to the latter case. Specifically, when the constant current flowing through the resistor R1 is smaller than a predetermined current, the drain current of the PMOS transistor P2 and the drain current of the NMOS transistor LN2 are smaller than a predetermined current, and the gate voltage of the PMOS transistor P2 is equal to or larger than a predetermined voltage, the activating circuit 10 causes an activation current to flow from the power supply terminal to the gate of the NMOS transistor LN2, thereby activating the constant current circuit. Other examples of the activating method include a method of causing the activation current to flow from the power supply terminal to the gate of the NMOS transistor N1 and a method of pulling the activation current from the gate of the PMOS transistor P2 to the ground terminal. However, in the activating methods, the gate of the NMOS transistor N1 becomes a high voltage before the drain thereof, and hence the voltage at the gate of the NMOS transistor N1 increases to a power supply potential and the voltage at the drain thereof is maintained at a ground potential. In other words, the NMOS transistor N1 is stabilized in a state in which a large current flows, and the NMOS transistor LN2 is stabilized in a state in which no current flows. Therefore, according to the activation methods, the voltage is not generated across the resistor R1, and hence the constant current circuit does not supply the constant current. In contrast to this, according to the activation method in the present invention, the drain of the NMOS transistor N1 becomes a high voltage before the gate thereof, and hence the NMOS transistor LN2 is stabilized in a state in which a current flows. Therefore, according to the activation method in the present invention, the voltage is generated across the resistor R1, and hence the constant current circuit supplies the constant current.

Each of the resistors R1 and R2 is a polysilicon resistor. The resistor R1 is used to generate a voltage obtained by subtracting the voltage generated across the resistor R1 from the threshold voltage difference between the NMOS transistors N1 and LN2. The resistors R1 and R2 have a sheet resistance value of approximately 300Ω to 400Ω, and hence the resistance values of the resistors R1 and R2 hardly change even when there are manufacturing fluctuations in semiconductor devices or a change in temperature.

Next, an operation of the constant current circuit is described.

Assume that the threshold voltage of the NMOS transistor N1 is 0.5 V and the threshold voltage of the NMOS transistor LN2 is 0.1 V. In this case, the threshold voltage difference between the NMOS transistors N1 and LN2 is 0.4 V. Assume that the gate-source voltage of the PMOS transistor P2 is 1.0 V. In this case, assume that the power supply voltage lowers to 1.2 V which is smaller than a sum voltage (1.4 V) of the threshold voltage difference between the NMOS transistors N1 and LN2 (0.4 V) and the gate-source voltage of the PMOS transistor P2 (1.0 V).

Then, in the first embodiment, the voltage generated across the resistor R1 is not a voltage (0.4 V) but a reduced voltage, and hence the current flowing into the resistor R1 is not the constant current and becomes smaller. That is, the constant current circuit cannot operate at a low power supply voltage.

In contrast to this, according to the second embodiment, the resistor R2 is further provided and each of the resistors R1 and R2 has a resistance value of half the resistance value of the resistor R1 described in the first embodiment. Then, a voltage of half the threshold voltage difference between the NMOS transistors N1 and LN2 (0.2 V) is generated across each of the resistors R1 and R2. The voltage generated across the resistor R1 is the voltage of half the threshold voltage difference between the NMOS transistors N1 and LN2 and the resistor R1 has the resistance value of half the resistance value of the resistor R1 described in the first embodiment, and hence a current value of the current flowing into the resistor R1 is equal to a current value of the current flowing into the resistor R1 described in the first embodiment. In other words, the constant current circuit may operate even at the low power supply voltage.

With this structure, when the resistor R2 is further provided, the voltage is generated across the resistor R2, and hence the voltage generated across the resistor R1 is reduced by the voltage generated across the resistor R2. Therefore, even when the power supply voltage is accordingly reduced, the constant current circuit may operate.

What is claimed is:

1. A constant current circuit for supplying a constant current, comprising:

a second PMOS transistor;

a first PMOS transistor through which a drain current flows based on a drain current of the second PMOS transistor;

a first NMOS transistor through which a drain current equal to the drain current of the first PMOS transistor flows when a voltage based on a drain voltage of the first PMOS transistor is applied to a gate of the first NMOS transistor;

a second NMOS transistor through which a drain current equal to the drain current of the second PMOS transistor flows when a voltage based on a gate voltage of the first NMOS transistor is applied to a gate of the second NMOS transistor, the second NMOS transistor being lower in threshold voltage than the first NMOS transistor;

a first resistor provided between a source of the second NMOS transistor and a ground terminal, for generating a voltage based on a threshold voltage difference between the first NMOS transistor and the second NMOS transistor to supply the constant current; and an activating circuit coupled to the gate of the second NMOS transistor, wherein the activating circuit is configured to cause an activation current to flow from a power supply terminal to the gate of the second NMOS transistor when the constant current is smaller than a predetermined current.

2. The constant current circuit according to claim 1, further comprising a second resistor provided between the gate of the first NMOS transistor and the gate of the second NMOS transistor.

3. The constant current circuit according to claim 1, wherein the activating circuit comprises an input terminal coupled to a gate of the second PMOS transistor and an output terminal coupled to the gate of the second NMOS transistor.

4. The constant current circuit according to claim 1, wherein the activating circuit comprises an input terminal coupled to a gate and a drain of the second PMOS transistor and an output terminal coupled to the gate and the drain of the second NMOS transistor.

* * * * *